US005973659A

United States Patent [19]

Kondoh

[11] Patent Number: 5,973,659

[45] Date of Patent: Oct. 26, 1999

[54] METHOD OF DRIVING ANTIFERROELECTRIC LIQUID CRYSTAL DISPLAY

[75] Inventor: Shinya Kondoh, Tokorozawa, Japan

[73] Assignee: Citizen Watch Co., Ltd., Tokyo, Japan

[21] Appl. No.: 08/484,906

[22] Filed: Jun. 7, 1995

[51] Int. Cl.[6] ..... G09G 3/36

[52] U.S. Cl. ..... 345/97; 345/95; 345/210

[58] Field of Search ..... 345/88, 89, 94, 345/95, 96, 97, 147, 148, 208, 209, 210

[56] References Cited

U.S. PATENT DOCUMENTS

| | | | |
|---|---|---|---|
| 5,459,481 | 10/1995 | Tanaka et al. | 345/95 |
| 5,615,026 | 3/1997 | Koden | 345/97 |

FOREIGN PATENT DOCUMENTS

| | | | |
|---|---|---|---|
| 2-173724 | 7/1990 | Japan . | |
| 4-34417 | 2/1992 | Japan . | |
| 5-100208 | 4/1993 | Japan . | |
| 5-249438 | 9/1993 | Japan . | |
| 6095624 | 4/1994 | Japan | 345/97 |
| 6202082 | 7/1994 | Japan | 345/97 |
| 6214215 | 8/1994 | Japan | 345/97 |
| 7092449 | 4/1995 | Japan | 345/97 |

OTHER PUBLICATIONS

Fourth International Conference on Ferroelectric Liquid Crystals, Program Book of Abstracts, Sep. 28–Oct. 1, 1993, Tokyo, Japan, Komaba Eminence, Tokyo.

"Full–Color Antiferroelectric Liquid Crystal Display," Norio Yamamoto et al., Ferroelectrics, 1993, vol. 149, pp. 295–304.

*Primary Examiner*—Lun-Yi Lao

*Attorney, Agent, or Firm*—Finnegan, Henderson, Farabow, Garrett & Dunner, L.L.P.

[57] ABSTRACT

A method realizes gradations on a display employing an antiferroelectric liquid crystal material. The method involves at least two scan periods to drive the display. The waveforms of voltages applied to the display in the two scan periods are symmetrical to each other with respect to 0 V. Each of the scan periods consists of a selected period and an unselected period. The waveform of a voltage applied in the selected period is modulated to control the response time of the antiferroelectric liquid crystal material and adjust the light transmittance thereof in the following unselected period.

2 Claims, 15 Drawing Sheets

METHOD OF DRIVING ANTIFERROELECTRIC LIQUID CRYSTAL DISPLAY

BACKGROUND OF THE INVENTION

1. Field of the Invention

The present invention relates to a method of driving a liquid crystal display employing an antiferroelectric liquid crystal material.

2. Description of the Related Art

Japanese Unexamined Patent Publication No. 2-173724 of Nippon Denso and Showa Shell Petroleum discloses a liquid crystal display employing an antiferroelectric liquid crystal material. This display realizes a wide view angle, a high-speed response, and a good multiplex property, and therefore, has been energetically studied.

FIG. 3 shows a cell of the liquid crystal display employing the antiferroelectric liquid crystal material. Polarizer plates 21*a* and 21*b* are arranged in a cross-Nicol relationship. The liquid crystal cell 22 is placed between the polarizer plates 21*a* and 21*b* so that the direction of the major axis of an average molecule of the liquid crystal material is in parallel with the polarization axis of one of the polarizer plates 21*a* and 21*b* when no electric field is applied. The cell 22 is black when no voltage is applied, and is white when a voltage is applied. FIG. 4(A) shows a hysteresis loop indicating changes in the light transmittance of the cell 22 and voltages applied to the cell 22. When the voltage applied to the cell 22 is increased to a value V1, the light transmittance starts to change, and when the voltage reaches a value V2, the light transmittance is saturated. When the voltage is decreased to a value V5, the light transmittance starts to decrease. When the voltage applied to the cell 22 has an opposite polarity and when its absolute value is increased to a value V3, the light transmittance starts to change, and when the voltage reaches a value V4, the light transmittance is saturated. When the value of the voltage is decreased to a value V6, the light transmittance starts to change. The cell 22 takes a second stable state (a ferroelectric state) if the voltage of a pulse applied thereto is higher than a specific value intrinsic to the antiferroelectric liquid crystal material and if the product of the width and height of the pulse is above a threshold. Under the same conditions but with an opposite polarity, the cell 22 takes a third stable state (a ferroelectric state). The cell 22 takes a first stable state (an antiferroelectric state) if the absolute value of the product of the width and height of the pulse is below the threshold.

When the voltage applied to the liquid crystal cell 22 is decreased before the light transmittance is saturated, the light transmittance decreases along the same hysteresis loop as that along which it has increased, as shown in FIG. 4(B).

FIG. 5 shows a matrix of electrodes for driving the antiferroelectric liquid crystal material. The electrodes include scan electrodes Y1 to Y128 and signal electrodes X1 to X160. A select voltage is applied successively to the scan electrodes Y1 to Y128. In synchronization with the select voltage, information signals are simultaneously applied to the signal electrodes X1 to X160. As a result, selected liquid crystal pixels are switched to display information. This is a time-division driving technique.

FIGS. 8(A) and 8(B) show a method of driving the antiferroelectric liquid crystal display, according to a prior art. A frame for driving the display consists of two scan periods, and each of the scan periods consists of a selected period and an unselected period. Each scan period involves a scan voltage, a signal voltage, and a synthesized voltage corresponding to the difference between the scan and signal voltages. The waveforms of two scan periods in each frame are symmetrical to each other with respect to 0 V, to prevent the liquid crystal material from burning and deteriorating. Each selected period involves two phases. A pulse width is 100 $\mu$s. Each unselected period is about 25 ms. In each selected period, a scan voltage has a predetermined height and a signal voltage determines the height of a synthesized waveform to select one of the first to third stable states. The selected state is maintained during the following unselected period. Namely, a light transmittance determined in a given selected period is maintained during the following unselected period, to display required data.

This conventional method only provides a large light transmittance for displaying white and a small light transmittance for displaying black, and is incapable of realizing intermediate levels of light transmittance. Namely, this method hardly displays gradations. One conventional technique for displaying gradations is an areal gradation technique. This technique groups pixels and handles each group as a pixel. This technique requires a complicated drive controller, provides poor resolution, and realizes only a limited number of gradations. Japanese Unexamined Patent Publication No. 4-34417 discloses a ferroelectric liquid crystal display that modulates pulse widths to realize gradations. This disclosure drives a ferroelectric liquid crystal material, which has SmC phases and only one stable state. Accordingly, this disclosure is quite different from the present invention, which drives an antiferroelectric liquid crystal material which has SmCA * phases and employs a different panel structure and different driving waveforms.

FIGS. 6 and 7 show a time-division technique of driving a liquid crystal display, disclosed in Japanese Unexamined Patent Publication No. 2-173724. This technique writes a screen in two frames. The waveforms of voltages applied in the first and second frames are symmetrical to each other with respect to 0 V. FIG. 6 shows the waveforms of voltages for setting an ON state of the display and corresponding light transmittance of the display. FIG. 7 shows the waveforms of voltages for setting an OFF state of the display and corresponding light transmittance of the display. As shown in FIG. 6, a signal applied to the scan electrodes consists of three phases. The first phase resets the liquid crystal material to the OFF state (antiferroelectric state). The second phase maintains the state set by the first phase. The third phase determines whether or not the liquid crystal material must be put in the ON state (ferroelectric state). In FIG. 6, the third phase is above a threshold for setting the ferroelectric state, so that the liquid crystal material is set to the ON state (ferroelectric state). In FIG. 7, the third phase is below the threshold, so that the liquid crystal material maintains the OFF state (antiferroelectric state).

In this way, the prior art realizes only the three stable states for an antiferroelectric liquid crystal material, to display only black and white. The prior art is incapable of displaying gradations.

SUMMARY OF THE INVENTION

An object of the present invention is to provide a method of driving an antiferroelectric liquid crystal display, to display gradations in addition to black and white at good resolution with a simple drive controller.

In order to accomplish the object, a first aspect of the present invention provides a method of driving an antiferroelectric liquid crystal display having a pair of substrates and an antiferroelectric liquid crystal material held between the substrates. The liquid crystal material has a matrix of cells serving as pixels. Faces of the substrates that face each other have scan and signal electrodes, respectively. The substrates are arranged between two polarizer plates whose polarization axes are orthogonal to each other. The liquid crystal material is arranged such that the major axis of an average molecule thereof is substantially in parallel with the polarization axis of one of the polarizer plates. This method controls a response time of the liquid crystal material changing from a ferroelectric state to an antiferroelectric state, to thereby change the light transmittance of the liquid crystal material during an unselected period. According to the prior art of FIGS. 8(A) and 8(B), light transmittance is unchangeable in unselected periods.

A second aspect of the present invention provides a method of driving an antiferroelectric liquid crystal display capable of displaying gradations. The liquid crystal display has a pair of substrates and an antiferroelectric liquid crystal material held between the substrates. The liquid crystal material has a matrix of cells serving as pixels. Faces of the substrates that face each other have scan and signal electrodes, respectively. This method controls gradations by setting the value of a voltage applied to a given pixel between V2 and V7 or between V4 and V8 as shown in FIG. 13 during a selected period. Here, the V2 and the V4 are the value of a voltage at which the light transmittance of the liquid crystal material is saturated, and the V7 and the V8 are the value of a voltage up to which the light transmittance of the liquid crystal material traces the same hysteresis loop in response to an increase or a decrease in the applied voltage, as shown in FIG. 4(B). An offset voltage in the unselected period may be changed in order to execute the above-described driving method in a good condition.

The ferroelectric state of the antiferroelectric liquid crystal material is more unstable than the antiferroelectric state thereof. Namely, molecules of the antiferroelectric liquid crystal material are always intending to return to the antiferroelectric state from the ferroelectric state. When a voltage is applied to the liquid crystal material, a force is produced against the force of returning to the antiferroelectric state. Depending on the magnitude of the force, a switching condition from the ferroelectric state to the antiferroelectric state is determined. Namely, adjusting the voltage applied to the liquid crystal material will change the speed or response time of the ferroelectric state changing to the antiferroelectric state. When a select pulse is applied to the liquid crystal material, the liquid crystal material is changed to the ferroelectric state, and when a pulse voltage whose polarity is opposite to the selected pulse is applied to the liquid crystal material, a force of returning the liquid crystal material to the antiferroelectric state is produced. Accordingly, the size of the voltage of opposite polarity also controls the response time of the liquid crystal material changing from the ferroelectric state to the antiferroelectric state. Controlling the response time of the antiferroelectric liquid crystal display will control the light transmittance thereof. As shown in FIGS. 1(A) to 1(D), a response time in which the liquid crystal material changes from the ferroelectric state to the antiferroelectric state in an unselected period is controlled to change the light transmittance of the display in the unselected period. This change in the light transmittance is viewed as a gradation by the human eye because the human eye is incapable of observing such a high-speed change in light transmittance in an unselected period. Namely, the human eye senses the change as a brightness level depending on the total quantity of light transmitted through the liquid crystal material in the unselected period.

In this way, the present invention controls a voltage applied to the liquid crystal material during a selected period, to easily display gradations. This is realized only by controlling the voltage without changing the structure or manufacturing processes of the display.

DESCRIPTION OF THE PREFERRED EMBODIMENTS

Preferred embodiments of the present invention will be explained next with reference to the drawings.

An antiferroelectric liquid crystal display has a pair of substrates and an antiferroelectric liquid crystal material held between the substrates. The liquid crystal material has a matrix of cells serving as pixels. Faces of the substrates that face each other have scan and signal electrodes, respectively. The substrates are arranged between two polarizer plates whose polarization axes are orthogonal to each other. The antiferroelectric liquid crystal material is arranged such that the major axis of an average molecule thereof is substantially in parallel with the polarization axis of one of the polarizer plates. A method according to the first aspect of the present invention controls a response time of the antiferroelectric liquid crystal material changing from a ferroelectric state to an antiferroelectric state, to thereby display gradations.

The liquid crystal display is driven in at least two scan periods. The waveforms of voltages applied to the display in the two scan periods are symmetrical to each other with respect to 0 V. Each of the scan periods consists of a selected period and an unselected period. The present invention modulates the waveform of a voltage applied in the selected period, to control the response time of the liquid crystal material and adjust the light transmittance thereof in the following unselected period.

In the selected period, a select pulse is used to put a given cell of the liquid crystal material in a ferroelectric state, and an auxiliary gradation pulse that is dependent on gradation display data is applied to the cell. The gradation pulse is used to control the response time of the liquid crystal material, to thereby control the light transmittance thereof in the following unselected period.

Figure 4A:
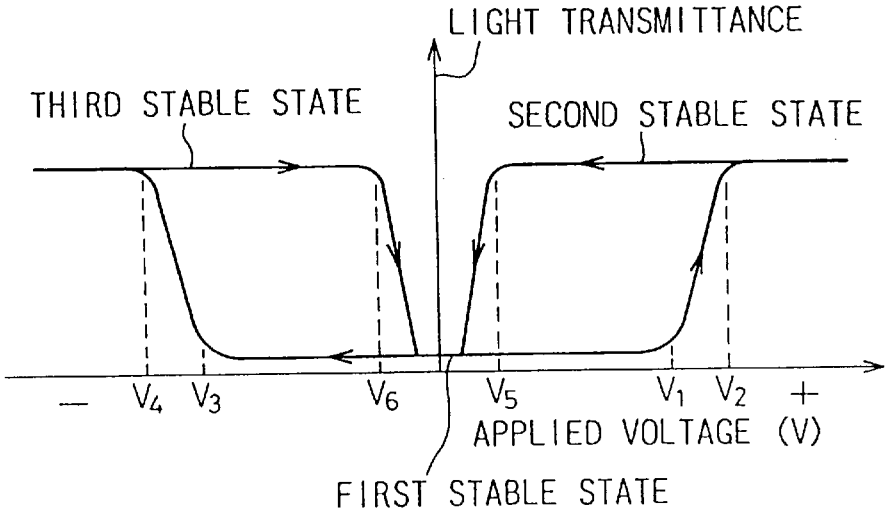
FIGS. 4(A) and 4(B) are hysteresis curves showing the characteristics of the antiferroelectric liquid crystal material.
Figure 9:
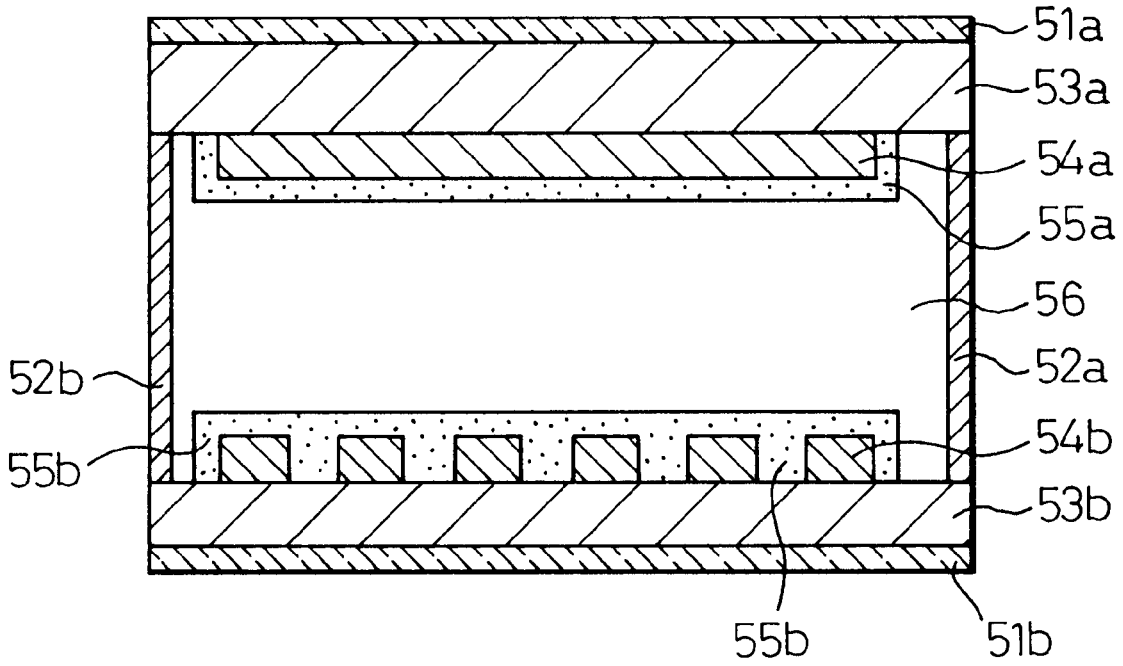
FIG. 9 shows a cell of an antiferroelectric liquid crystal display employing the method of the present invention.

FIG. 9 shows a cell of the liquid crystal display. The glass substrates 53*a* and 53*b* hold the antiferroelectric liquid crystal layer 56 of about 2 μm thick. Faces of the glass substrates 53*a* and 53*b* that face each other has the electrodes 54*a* and 54*b*, respectively. The electrodes 54*a* and 54*b* are coated with polymer alignment films 55*a* and 55*b*, respectively. The alignment films 55*a* and 55*b* are processed by rubbing. The first polarizer plate 51*a* is arranged on the glass substrate 53*a* such that the polarization axis of the polarizer plate is in parallel with a rubbing axis. The second polarizer plate 51*b* is arranged on the other glass substrate 53*b*. The polarization axis of the second polarizer plate 51*b* is orthogonal to that of the first polarizer plate 51*a*. The voltage V2 (FIG. 4(A)) of the antiferroelectric liquid crystal material of the embodiment is about 30 V.

FIRST EMBODIMENT

FIGS. 1(A) to 1(D) show the waveforms of voltages for driving the antiferroelectric liquid crystal display and the light transmittance thereof. To drive the display, each frame consists of two scan periods, and each of the scan periods consists of a selected period and an unselected period. The waveforms of voltages applied in two scan periods in a given frame are symmetrical to each other with respect to 0 V. Each selected period involves four phases. A pulse width is 100 μs. Each unselected period is about 7.5 ms. To control a response time of the antiferroelectric liquid crystal material changing from a ferroelectric state to an antiferroelectric state, this embodiment fixes a scan waveform in each selected period and changes a signal waveform in the selected period according to gradation data, to thereby change a select pulse synthesized from the scan and signal waveforms in the selected period. The absolute voltage value of a synthesized select pulse in a given selected period is 49 V in FIG. 1(A), 43 V in FIG. 1(B), 39 V in FIG. 1(C), and 36 V in FIG. 1(D). These figures show the synthesized waveforms and corresponding light transmittance of the liquid crystal material. In this way, changing the absolute voltage value of a select pulse in a selected period controls the light transmittance of the liquid crystal material in the following unselected period. Total light transmittance of the liquid crystal material determined by the above voltages are, with FIG. 1(A) being 100% as a reference, about 88% in FIG. 1(B), about 75% in FIG. 1(C), and about 43% in FIG. 1(D).

The unselected period is about 7.5 ms which is too short for the human eye to recognize changes in the light transmittance of the liquid crystal material. Namely, the human eye only observes the total quantity of transmitted light in the unselected period as a level of brightness, i.e., a gradation.

Instead of changing the absolute voltage value of a select pulse, the width of the select pulse may be changed to provide the same effect.

SECOND EMBODIMENT

Figure 1A:
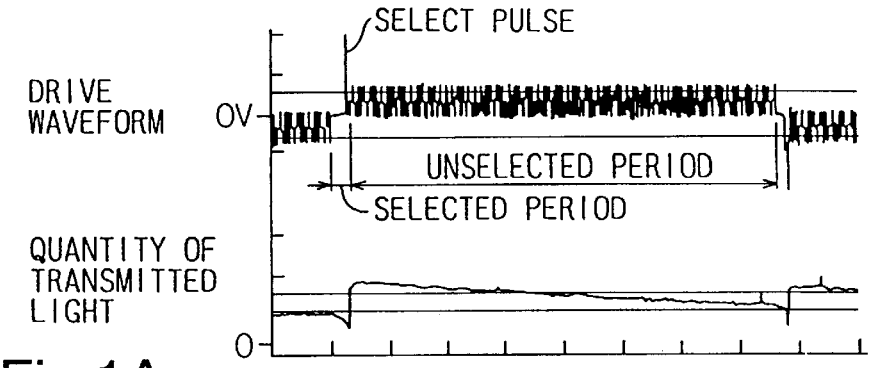
FIGS. 1(A) to 1(D) show the waveforms of driving voltages and corresponding light transmittance according to a first embodiment of the present invention.
Figure 1B:
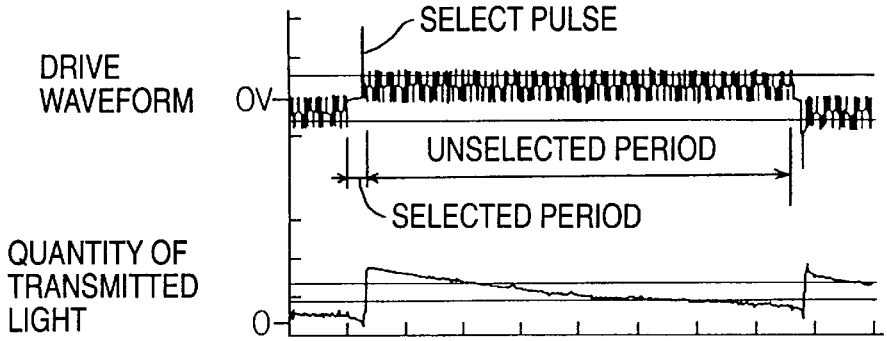
Figure 1C:
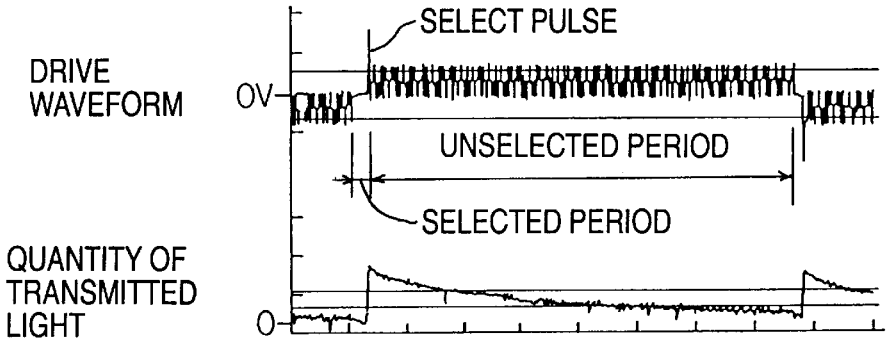
Figure 1D:
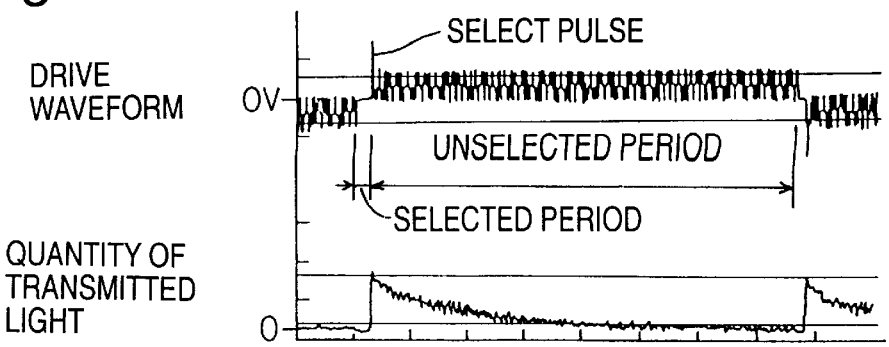
Figure 2A:
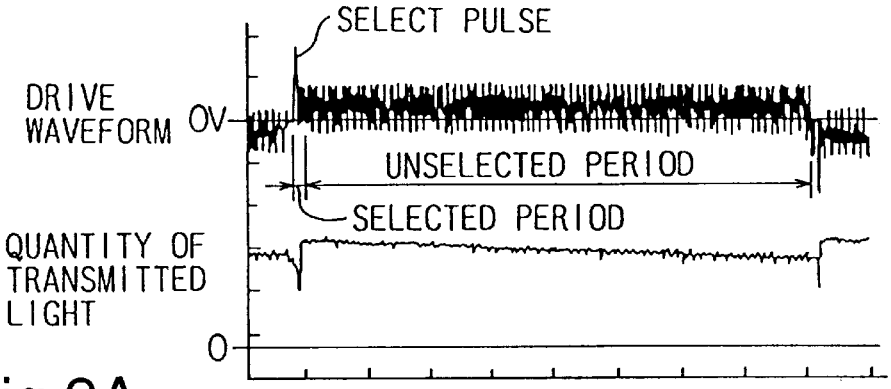
FIGS. 2(A) to 2(D) show the waveforms of driving voltages and corresponding light transmittance according to a second embodiment of the present invention.
Figure 2B:
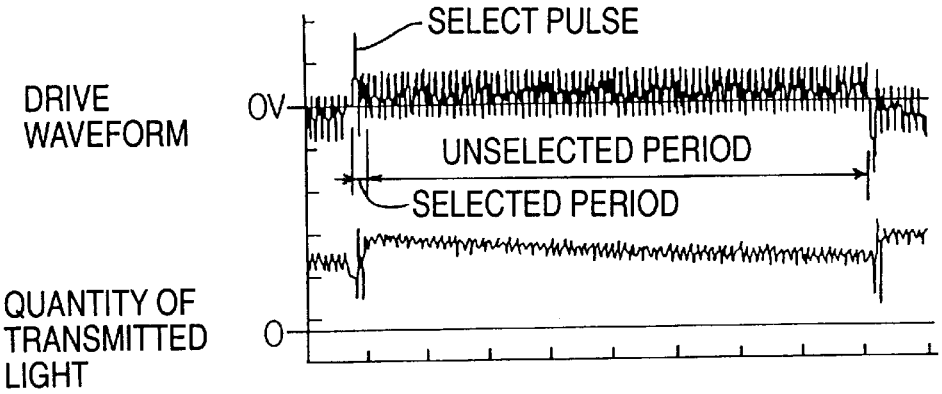
Figure 2C:
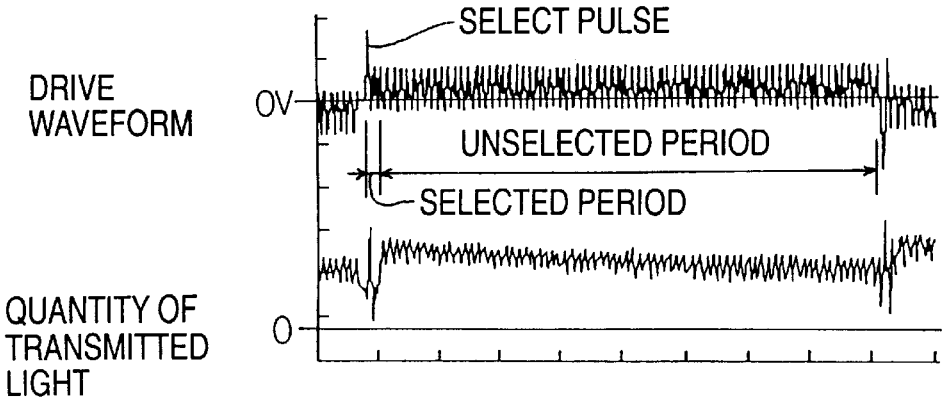
Figure 2D:
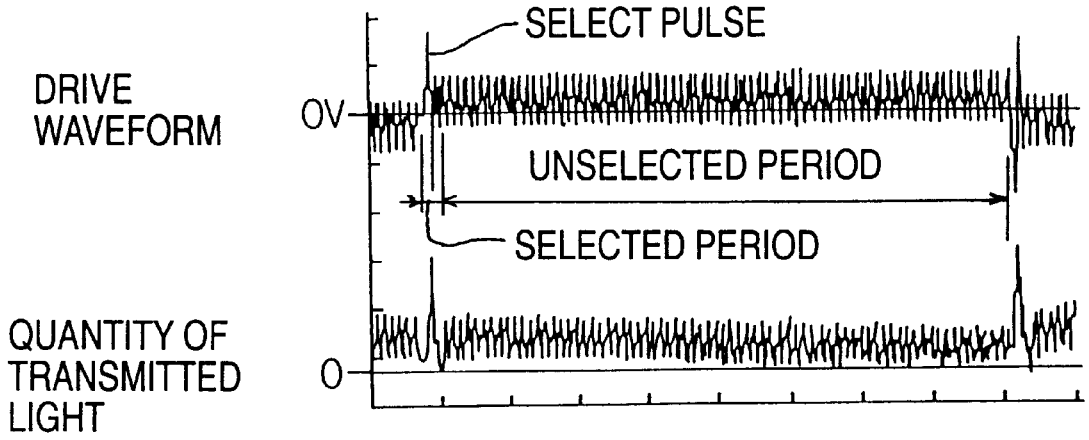
Figure 2E:
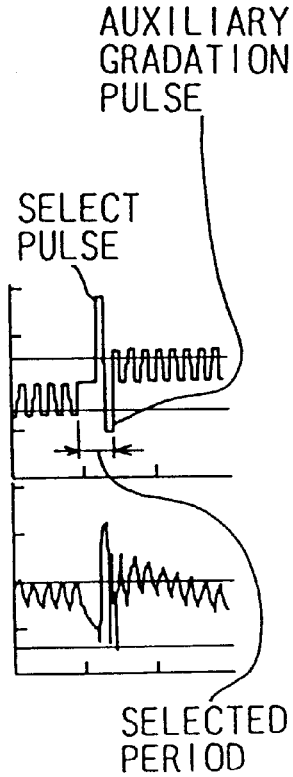
FIG. 2(E) is an enlarged view showing a selected period of FIG. 2(C)
Figure 3:
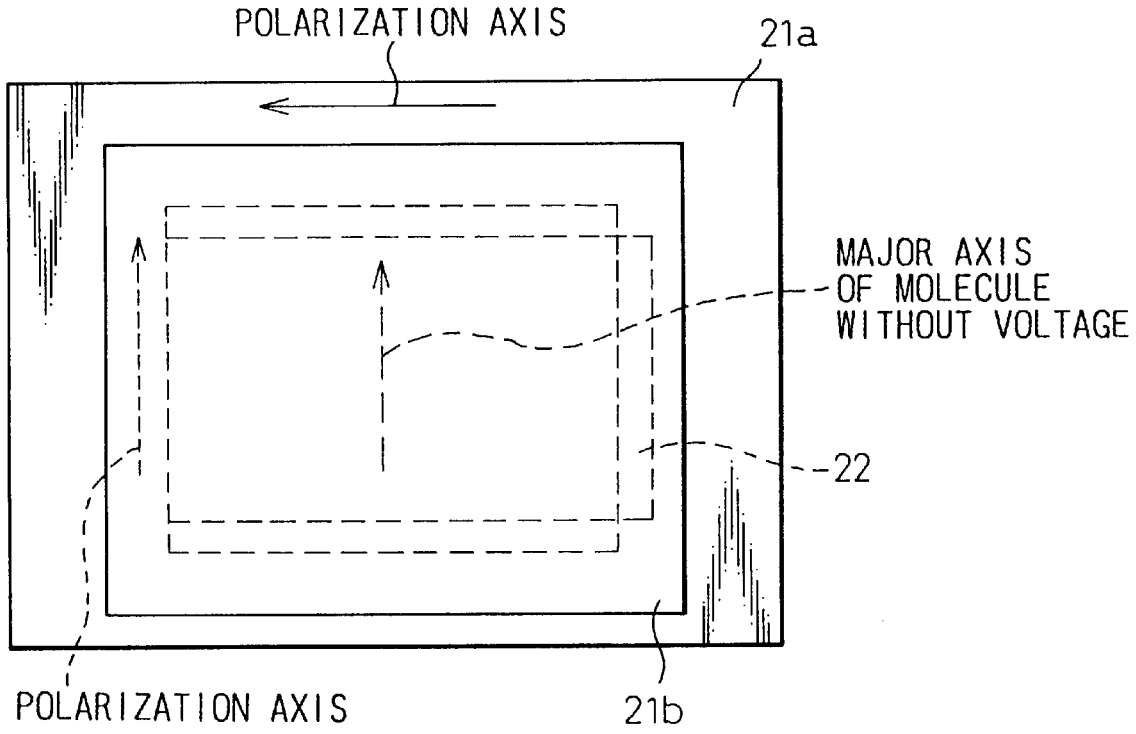
FIG. 3 shows a display having an antiferroelectric liquid crystal material and polarizer plates, employing the method of the present invention.

FIGS. 2(A) to 2(D) show the second embodiment of the present invention employing an auxiliary gradation pulse in a selected period. Each frame consists of two scan periods, and each of the scan periods consists of a selected period and an unselected period. The waveforms of the two scan periods in each frame are symmetrical to each other with respect to 0 V. Each selected period consists of three phases. A pulse width is 100 μs. Each unselected period is about 7.5 ms. This embodiment fixes the voltage of a synthesized select pulse applied in the second phase of each selected period to 35 V. The auxiliary gradation pulse is applied in the third phase of each selected period. The second embodiment puts the antiferroelectric liquid crystal material in a ferroelectric state in the second phase of each selected period. Thereafter, the voltage of the gradation pulse is determined according to gradation data, to control a response time of the liquid crystal material changing from the ferroelectric state to an antiferroelectric state. This controls the amount of transmitted light during the following unselected period, to display a gradation. FIGS. 2(A) to 2(D) show the waveforms of synthesized driving voltages and corresponding quantities of transmitted light. The absolute voltages of synthesized auxiliary gradation pulses are 0 V in FIG. 2(A), 12 V in FIG. 2(B), 21 V in FIG. 2(C), and 26 V in FIG. 2(D). FIG. 2(E) is an enlarged view showing a selected period of FIG. 2(C). In this way, the second embodiment controls the quantity of light transmitted in each unselected period by changing the voltage of an auxiliary gradation pulse in the preceding selected period. The quantities of light transmitted in each unselected period are, with FIG. 2(A) being 100% as a reference, about 62% in FIG. 2(B), about 45% in FIG. 2(C), and about 21% in FIG. 2(D). In this way, the second embodiment is capable of displaying gradations like the first embodiment.

THIRD EMBODIMENT

Figure 13:
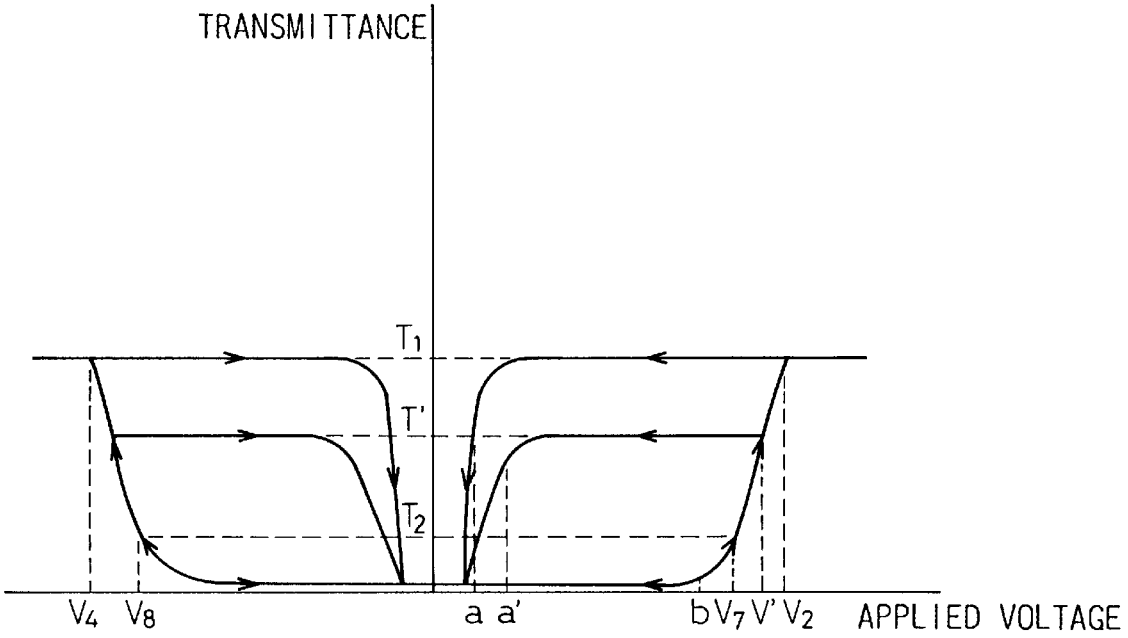
FIG. 13 is a graph showing voltages applied to an antiferroelectric liquid crystal display and corresponding light transmittance of the display.

A method of driving an antiferroelectric liquid crystal display according to the second aspect of the present invention will be explained next. The liquid crystal display has a pair of substrates and an antiferroelectric liquid crystal material held between the substrates. The liquid crystal material has a matrix of cells serving as pixels. Faces of the substrates that face each other have scan and signal electrodes, respectively. This method sets the value of a voltage applied to a given pixel between V2 and V7 or between V4 and V8 as shown in FIG. 13 during a selected period. Here, the V2 and the V4 are the value of a voltage at which the light transmittance of the liquid crystal material is saturated, and the V7 and V8 are the value of a voltage up to which the light transmittance of the liquid crystal material traces the same hysteresis loop when the voltage is increased or decreased. An offset voltage in the unselected period may be changed in order to execute above-described driving method in a good condition.

Figure 4B:
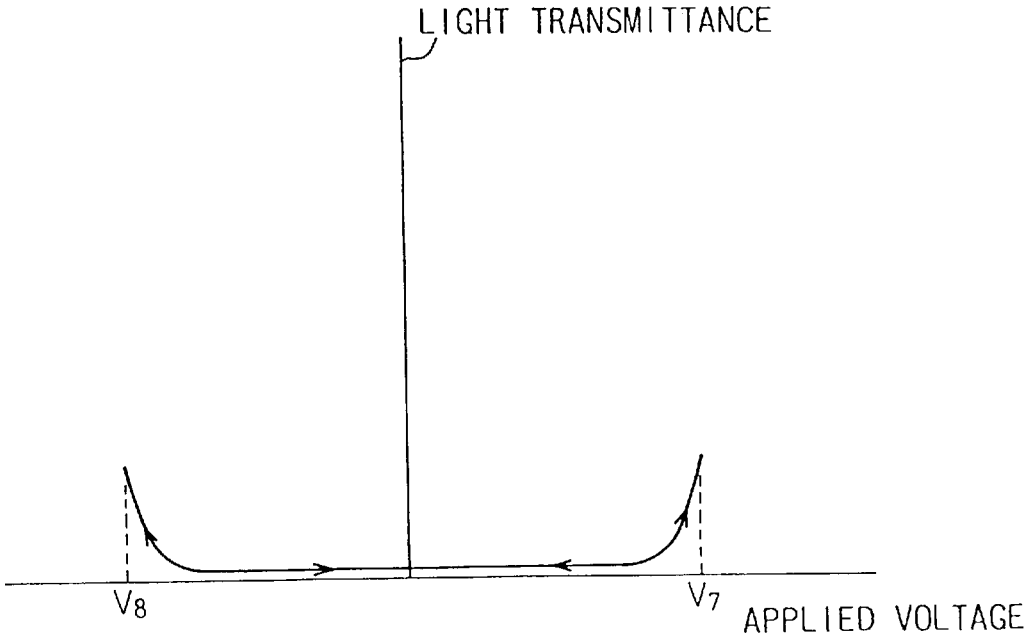
Figure 5:
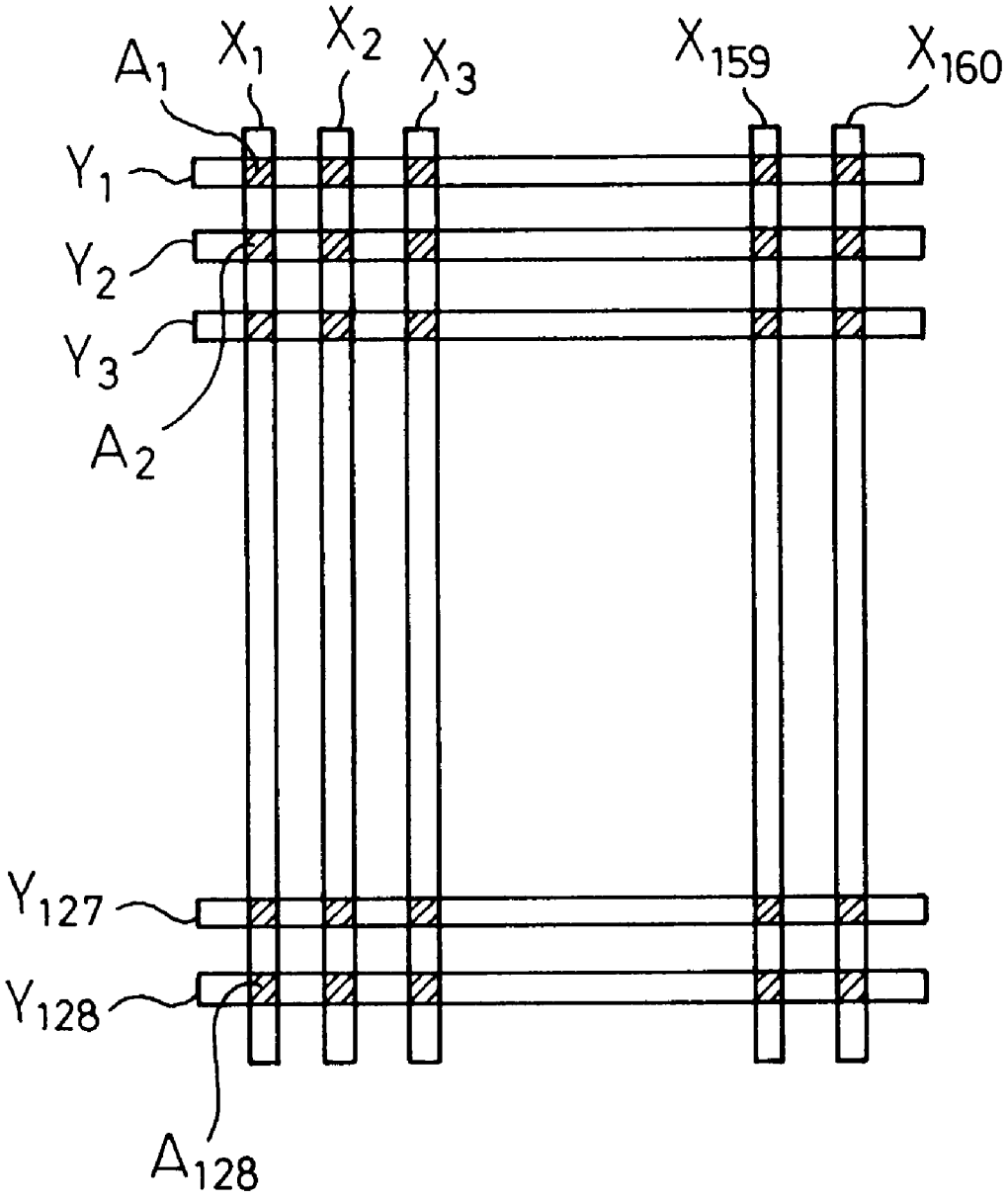
FIG. 5 shows a matrix of electrodes for driving liquid crystal cells.
Figure 6:
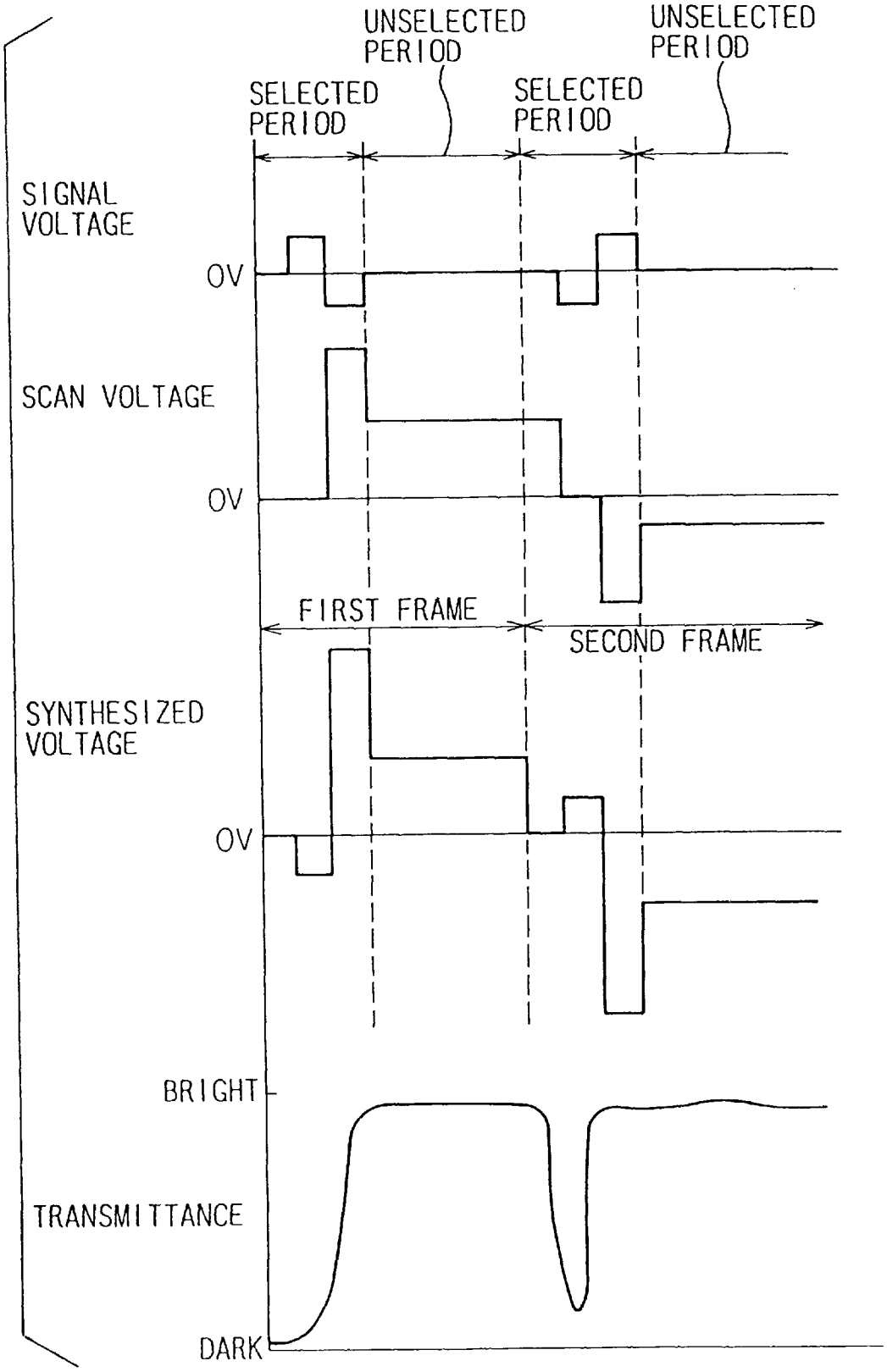
Fig.6 (PRIOR ART)
FIGS. 6 and 7 show a method of driving a liquid crystal display, according to a prior art.
Figure 7:
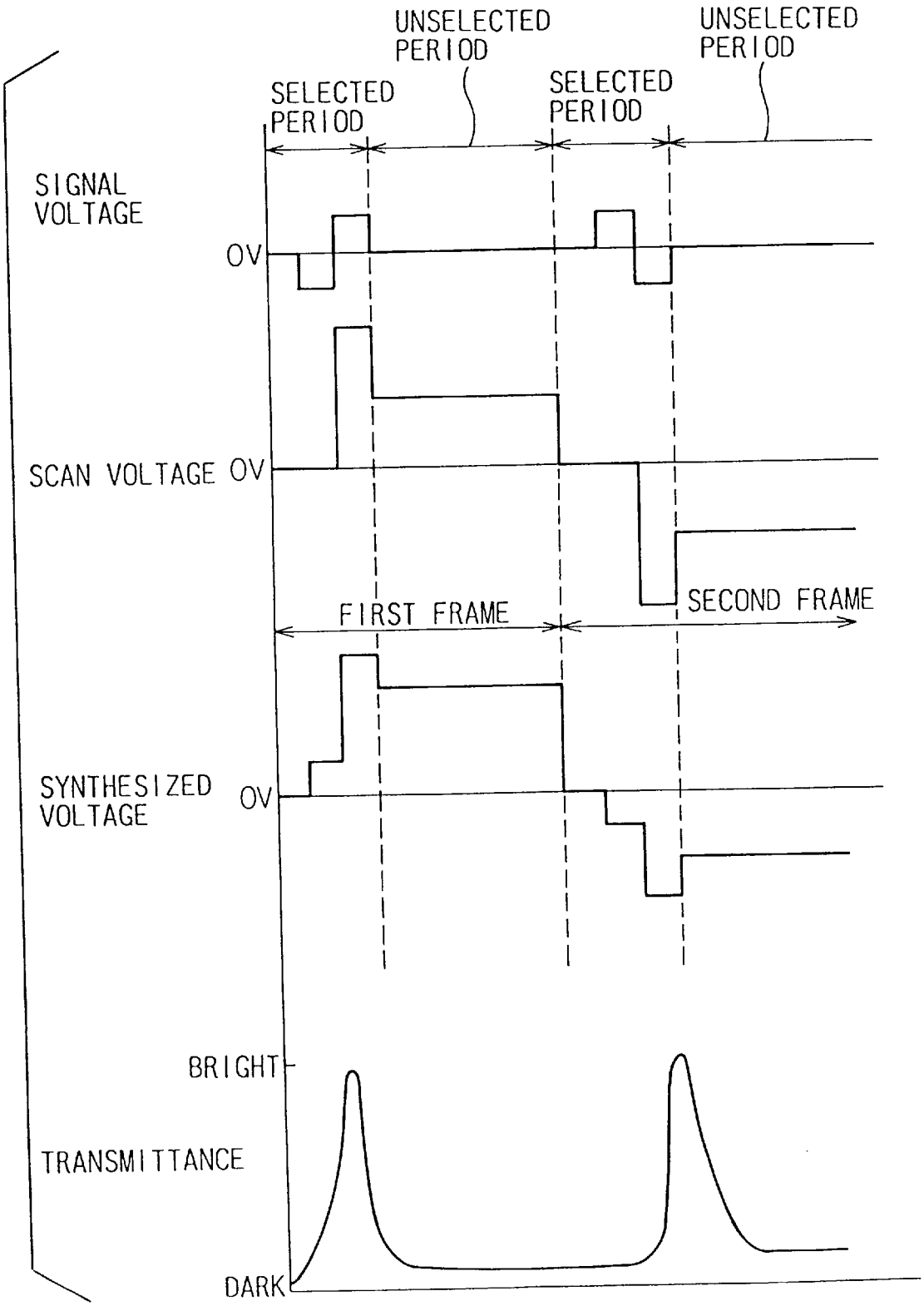
Fig.7 (PRIOR ART)
Figure 8A:
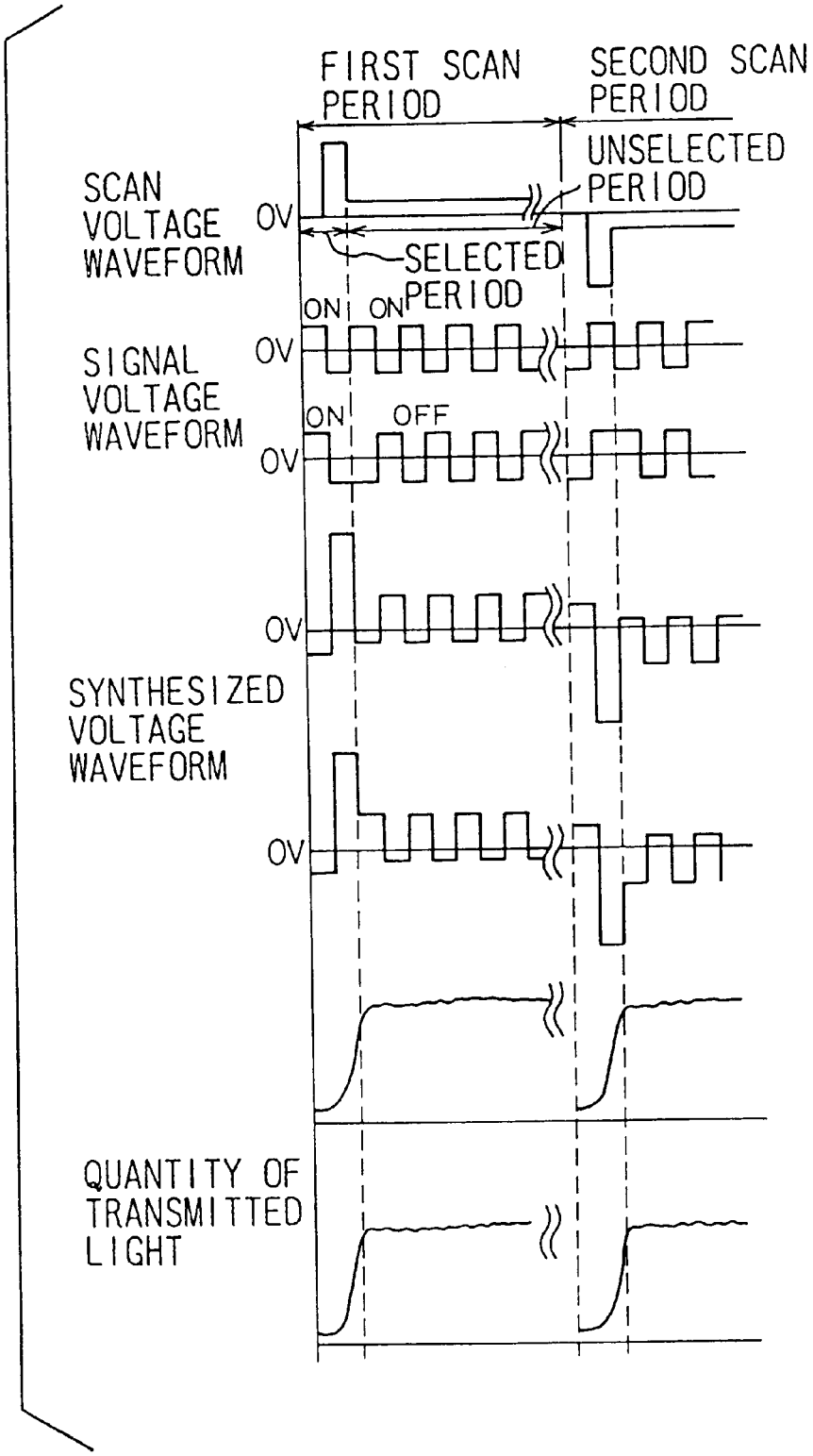
Fig.8A (PRIOR ART)
FIGS. 8(A) and 8(B) show a method of driving a liquid crystal display, according to a prior art.
Figure 8B:
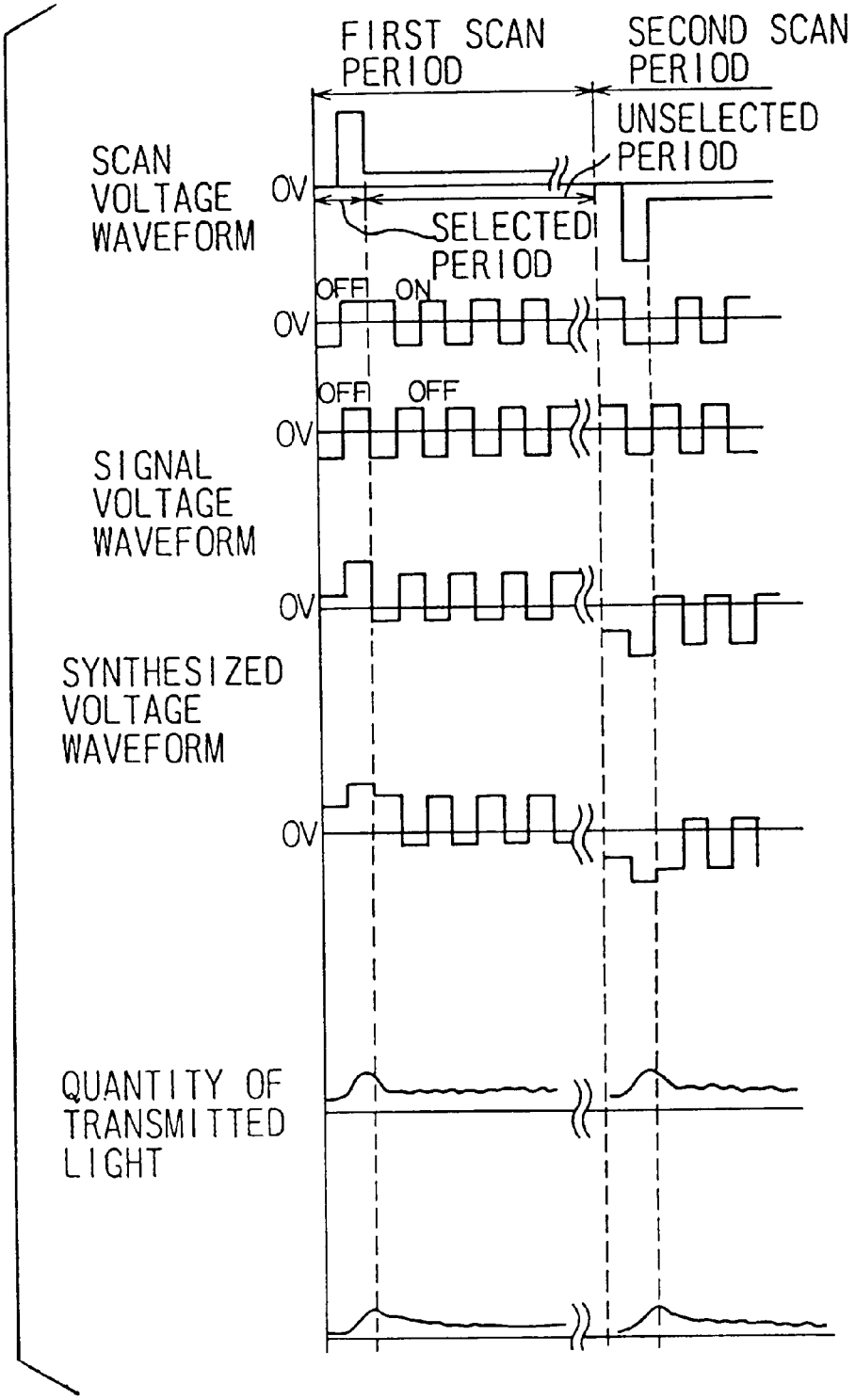
Fig.8B (PRIOR ART)

The second aspect of the present invention will be explained next in detail with reference to FIG. 13. This figure is a combination of FIGS. 4(A) and 4(B). When a voltage applied to the liquid crystal material of FIG. 13 is increased, the light transmittance thereof is saturated at the voltage V2. Before the voltage V2, there is a voltage V'. When the voltage applied to the liquid crystal material is decreased from the value V', the light transmittance T' of the liquid crystal cell at the value V' is maintained up to a certain voltage. This phenomenon is used when changing the product of the width and height of a voltage pulse applied in a selected period, to easily display gradations. Namely, the value of a voltage applied to the liquid crystal material in a selected period is optionally set between the values V2 and V7, or between the values V4 and V8, to continuously change the light transmittance of the liquid crystal material in the range of T1 to T2. Here, the V2 and the V4 are the value of a voltage at which the light transmittance of the liquid crystal material is saturated, and the V7 is the value of a voltage up to which the light transmittance traces the same hysteresis loop in response an increase or a decrease in the applied voltage.

It is difficult to display many gradations only by changing the product of the width and height of a voltage pulse applied in a selected period. When driving the antiferroelectric liquid crystal material, the absolute value of an offset voltage is set between a point "a" on the hysteresis loop of FIG. 13 where the light transmittance of the liquid crystal material starts to change when a voltage applied to the liquid crystal material is dropped and a point "b" on the same loop where the light transmittance starts to change when the applied voltage is increased. The point "a" will shift to a point "a'" when the voltage value V' is selected for the light transmittance T'. Accordingly, it is necessary to change the offset voltage when a switching pulse voltage is changed. To properly display a gradation by changing the product of the width and height of a voltage pulse applied in a selected period, it is necessary to optimize the offset voltage.

The liquid crystal material used for the first and the second embodiments has the following characteristic. Namely, even if an appropriate direct current has been applied to the liquid crystal cell for a predetermined period after a pulse having a predetermined pulse width has been applied and a light transmittance of the liquid crystal cell has changed, the liquid crystal material cannot maintain the light transmittance generated by the applied pulse during the above-described predetermined period.

FOURTH EMBODIMENT

The fourth embodiment is based on the second aspect of the present invention.

This embodiment employs the same liquid crystal cell as that shown in FIG. 9. A pair of glass substrates 53*a* and 53*b* hold an antiferroelectric liquid crystal layer 56 of about 2 μm thick. Faces of the glass substrates 53*a* and 53*b* that face each other has electrodes 54*a* and 54*b*, respectively. The electrodes 54*a* and 54*b* are coated with high-polymer alignment films 55*a* and 55*b*, respectively. The alignment films 55*a* and 55*b* are processed by rubbing. A first polarizer plate 51*a* is arranged on the glass substrate 53*a* such that the polarization axis of the polarizer plate is in parallel with a rubbing axis. A second polarizer plate 51*b* is arranged on the other glass substrate 53*b*. The polarization axis of the second polarizer plate 51*b* is orthogonal to that of the first polarizer plate 51*a*.

Figure 10:
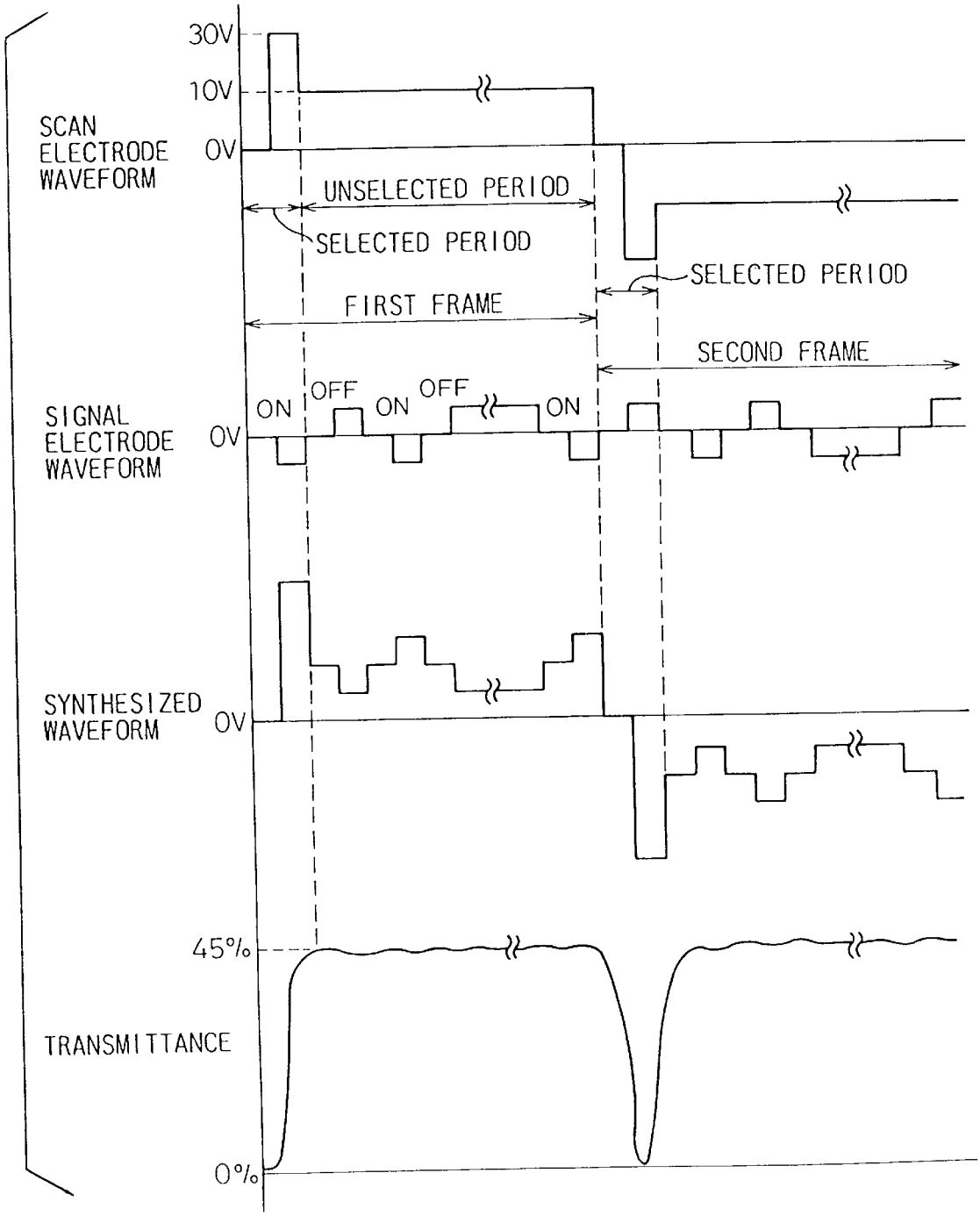
FIG. 10 shows signal waveforms and light transmittance to realize gradations according to the present invention.
Figure 11:
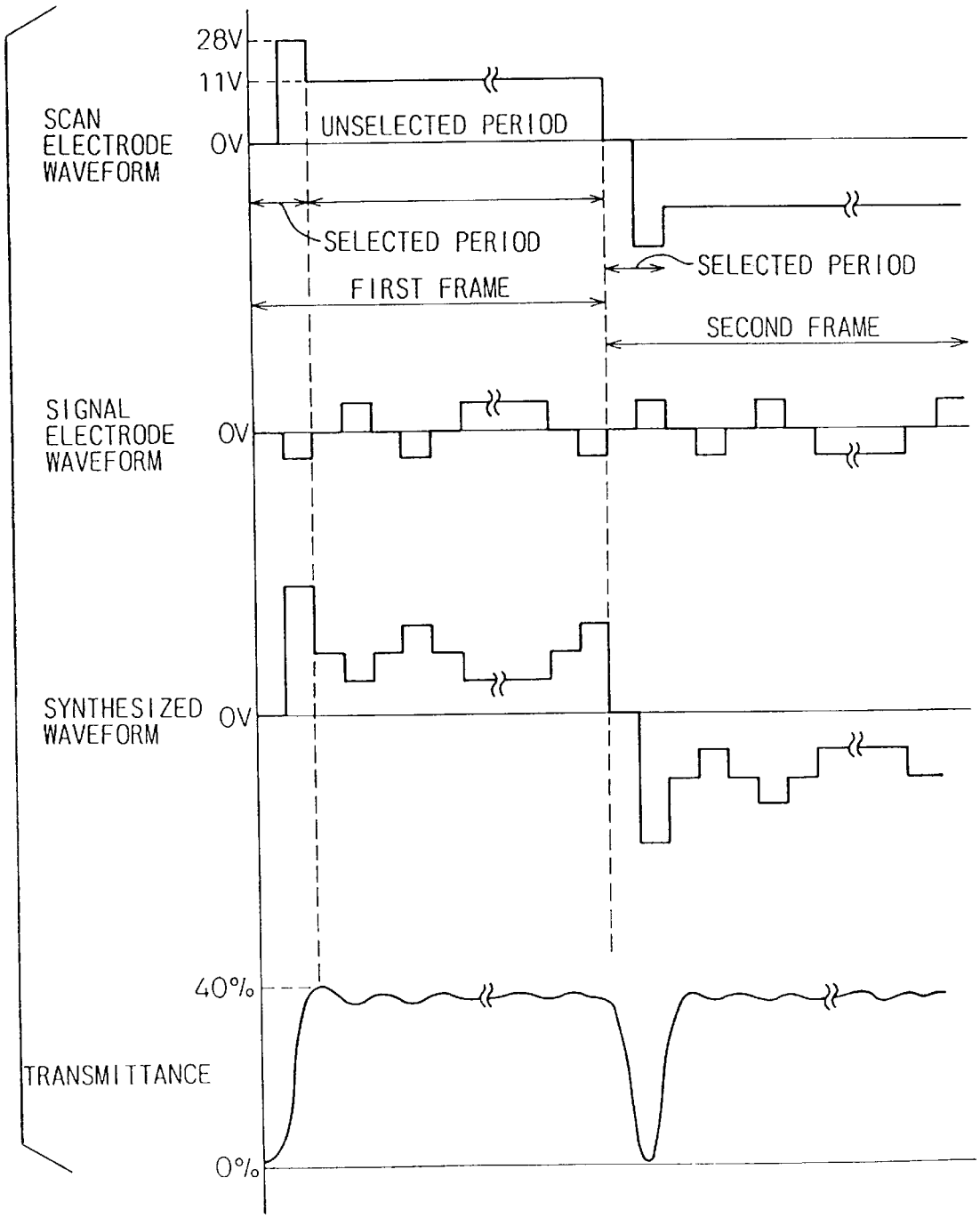
FIG. 11 shows signal waveforms and light transmittance to realize gradations according to the present invention.
Figure 12:
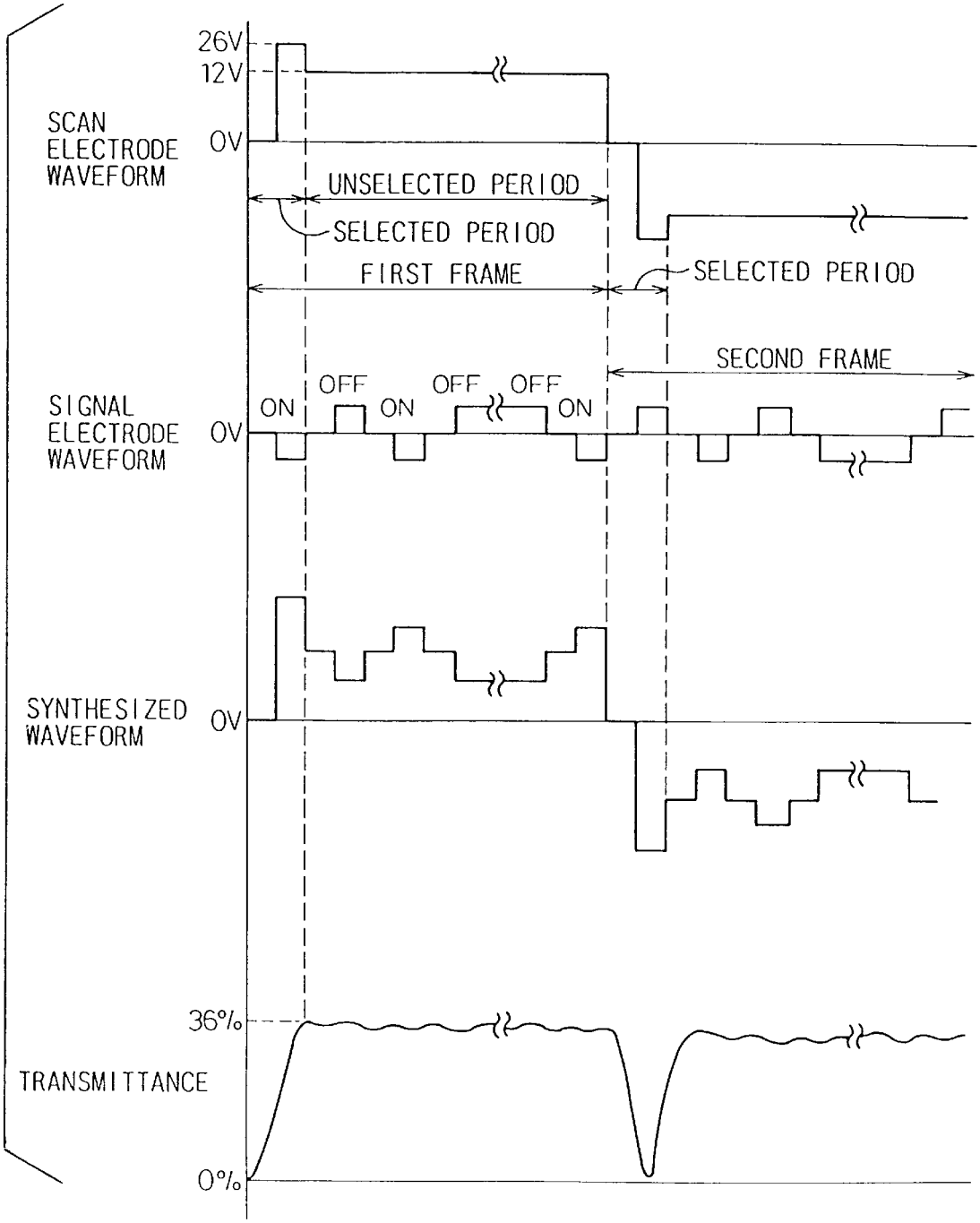
FIG. 12 shows signal waveforms and light transmittance to realize gradations according to the present invention.

FIGS. 10 to 12 show the waveforms of signals for driving the liquid crystal material and corresponding light transmittance of the liquid crystal material, in which FIG. 10 is for displaying a gradation level 1 of white, FIG. 11 is for displaying a gradation level 2 of white, and FIG. 12 is for displaying a gradation level 3 of white. Each selected period involves two pulses. Each scan consists of two frames. Voltages applied in the first and second frames of each scan are symmetrical to each other with respect to 0 V. Each pulse width is 100 μs. The voltage of a scan pulse in the first phase in the first frame in a given scan period is 0 V, and the voltage of a scan pulse in the second phase thereof is 30 V in FIG. 10, 28 V in FIG. 11, and 26 V in FIG. 12. An offset voltage in the following unselected period is 10 V in FIG. 10, 11 V in FIG. 11, and 12 V in FIG. 12. The voltage of a scan pulse in the first phase of the second frame in the same scan period is 0 V and the voltage of a scan pulse in the second phase of the same is −30 V in FIG. 10, −28 V in FIG. 11, and −26 V in FIG. 12. An offset voltage in the following unselected period is −10V in FIG. 10, −11 V in FIG. 11, and −12 V in FIG. 12. The voltage of a signal pulse applied in synchronization with the scan pulse is 0 V in the first phase and −6 V in the second phase under an ON state, and under an OFF state, 0 V in the first phase and 6 V in the second phase. A frame period is about 80 ms. As a result, the light transmittance of the liquid crystal material is 45% for 30 V in FIG. 10, 40% for 28 V in FIG. 11, and 36% for 26 V in FIG. 12. In this way, the method of the present invention is capable of properly displaying gradations.

As explained above, the present invention modulates the waveform of a driving voltage, or applies an auxiliary gradation pulse according to gradation data after a select pulse, to control the response time of an antiferroelectric liquid crystal material changing from a ferroelectric state to an antiferroelectric state, to thereby control the light transmittance of the liquid crystal material in the following unselected period and properly display gradations.

The liquid crystal material used for the third embodiment has the following characteristic. Namely, if an appropriate direct current has been applied to the liquid crystal cell for a predetermined period after a pulse having a predetermined pulse width has been applied and a light transmittance of the liquid crystal cell has changed, the liquid crystal material can maintain the light transmittance generated by the applied pulse during the above-described predetermined period.

Consequently, the driving method of the present invention is capable of properly displaying gradations on an antiferroelectric liquid crystal display.

I claim:

1. A method of driving an antiferroelectric liquid crystal display having a pair of substrates, an antiferroelectric liquid crystal material held between the substrates and forming a matrix of cells serving as pixels, a scan electrodes formed on one of the substrates, and signal electrodes formed on the other substrate and facing the scan electrodes, comprising the step of setting the value of a voltage applied to a given pixel during a selected period between V2 and V7 or between V4 and V8, to display a gradation, the V2 and V4 being the value of a voltage at which the light transmittance of the liquid crystal material is saturated, the V7 and V8 being the value of a voltage up to which the light transmittance of the liquid crystal material traces the same hysteresis loop when the applied voltage is increased or decreased.

2. The method according to claim 1 wherein, when the product of the width and height of a voltage pulse in a selected period is changed, an offset voltage in the following unselected period is changed accordingly.

* * * * *